US005383826A

United States Patent [19]

Michael

[11] Patent Number: 5,383,826

[45] Date of Patent: Jan. 24, 1995

[54] USER INTERFACE CONSOLE FOR EXERCISE EQUIPMENT

[75] Inventor: Farnet Michael, Auburn, Ala.

[73] Assignee: Diversified Products Corporation, Opelika, Ala.

[21] Appl. No.: 959,437

[22] Filed: Oct. 13, 1992

[51] Int. Cl.[6] ..... A63B 21/005

[52] U.S. Cl. ..... 482/3; 482/1; 482/4; 482/901

[58] Field of Search ..... 482/1, 3–9, 482/54, 900–903, 57

[56] References Cited

U.S. PATENT DOCUMENTS 5,067,710 11/1991 Watterson et al. ..... 482/901 X 5,104,120 4/1992 Watterson et al. ..... 482/5

*Primary Examiner*—Richard J. Apley

*Assistant Examiner*—Glenn Richman

*Attorney, Agent, or Firm*—Banner, Birch, McKie & Beckett

[57] ABSTRACT

A user interface console for programming exercise parameters relating to the operation of an exercise device, including a display for displaying the value of each of the exercise parameters and a selector for selecting one of the exercise parameters to be programmed. The interface console further includes a programmer for programming the selected exercise parameter with a desired value; the programmer includes an encoder unit having a rotatable shaft, wherein the user programs the selected exercise parameter by rotating the rotatable shaft. In response, the encoder unit generates electrical signals representative of the incremental motion of the rotatable shaft. The interface console further includes a microprocessor, coupled to the programming means and the display, for receiving the electrical signals and for responsively adjusting the value of the selected exercise parameter.

22 Claims, 5 Drawing Sheets

USER INTERFACE CONSOLE FOR EXERCISE EQUIPMENT

BACKGROUND OF THE INVENTION

The present invention relates generally to a user interface console for exercise equipment, and more particularly, to a console device for programming functions or parameters relating to the operation of exercise equipment, including, for example, stationary exercise bicycles, exercise treadmills, steppers, rowers, skiers, or the like.

Advances in exercise equipment over the years have resulted in increasingly complex control systems being utilized to control such equipment. For example, control systems for use with treadmills, stationary bikes, and other exercise equipment allow for sophisticated control and measurement of the user's performance. This increase in complexity has led to an increase in the complexity of the user interfaces, the input and output devices employed to control the equipment.

For example, it is typical for exercise equipment to utilize keypad technology as a user input or interface mechanism. One type of interface mechanism employing keypad technology is a number keypad. Here the user enters a desired value for a particular parameter directly by way of a push button number key pad.

Typically, in systems employing a numeric keypad, the user may be confused if a number is entered incorrectly. The user may have to reenter the desired value and/or re-program the system entirely.

In another type interface configuration, the user may enter a desired input by way of one or more push button keys, for example "up" and/or "down" input keys. Here, the user depresses the "up" or "down" key until the particular parameter changes to the user's desired value. In these type systems, the rate of change of the parameter's value is typically at a constant rate.

In those systems employing an "up" and "down" key configuration, the user must be patient, continually observing the value of the parameter, and exhibit good "timing" in order to release the appropriate button when the parameter nears the desired value.

As a result, there exists a need for an improved input and output device for use in situations where exercise parameters may be programmed with ease.

SUMMARY OF THE INVENTION

It is an object of the present invention to provide an easy-to-use user interface console, having programmable operating or exercise parameters, for use with an exercise device, for example an exercise bicycle, a treadmill, a stepper, a rower, a skier, or the like.

A further object of the present invention is to provide a user interface console for exercise equipment wherein the console allows the user to program and monitor the exercise parameters.

Another object of the present invention is to employ an encoder device in a user interface console to allow a user to program the operating or exercise parameters of an exercise device.

Accordingly, the foregoing objectives, as well as others, are achieved by the present invention, which in a first principal aspect, includes a user interface console for controlling the operating conditions of an exercise device, wherein the interface console has a program mode for programming exercise parameters. The user interface console includes interfacing means for allowing a user of the exercise equipment to program the exercise parameters. The interfacing means includes an encoder unit, having a rotatable shaft, for receiving user inputs used to program the exercise parameters. The encoder unit generates electrical signals representative of the user inputs.

The interface console may further include microprocessor means coupled to the interfacing means for receiving the electrical signals and for responsively adjusting the operating condition of the exercise equipment.

In addition, the interfacing means may include switch means for allowing the user to select one or more of the exercise parameters to be programmed wherein the user selects a one of the exercise parameters by actuating the switch means. The switch means may be integrated in the encoder unit such that the rotatable shaft is capable of responsively engaging and responsively actuating the switch means.

The present invention may further include display means coupled to the microprocessor means for displaying the value of each of the exercise parameters.

In another principal aspect, the present invention is a user interface console for programming exercise parameters relating to the operation of an exercise device, including displaying means for displaying the value of each of the exercise parameters and selecting means for selecting at least one exercise parameters to be programmed. The interface console further includes programming means for programming the selected exercise parameter with a desired value; the programming means includes an encoder unit having a rotatable shaft, whereby the user programs the selected exercise parameter by rotating the rotatable shaft. In response, the encoder unit generates electrical signals representative of the incremental motion of the rotatable shaft. The interface console further includes microprocessor means, coupled to the programming means and the display means, for receiving the electrical signals and for responsively adjusting the value of the selected exercise parameter.

BRIEF DESCRIPTION OF THE DRAWINGS

In the course of the detailed description of preferred embodiments to follow, reference will be made to the attached drawings, in which.

DETAILED DESCRIPTION OF THE PREFERRED EMBODIMENTS

Figure 1:
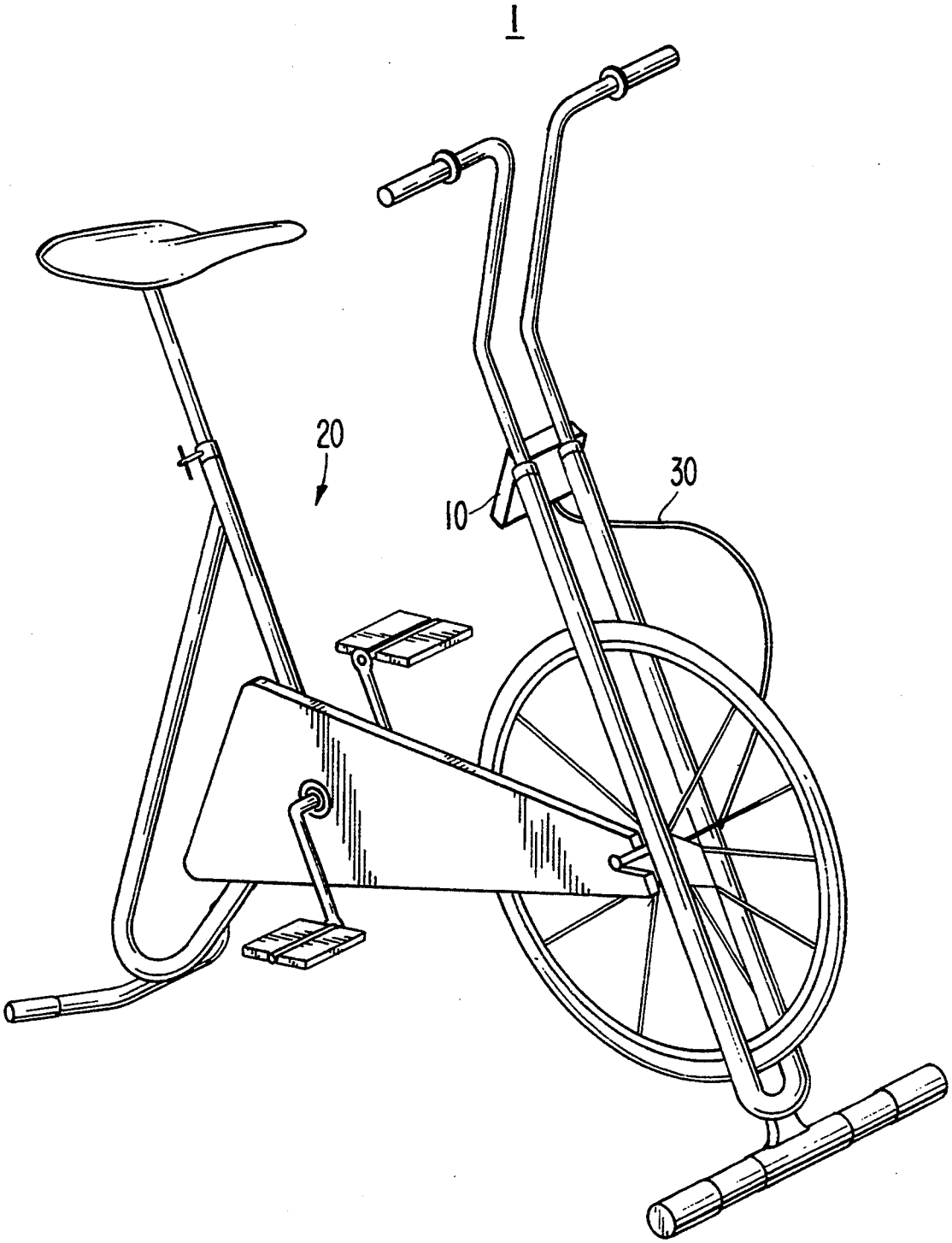
FIG. 1 illustrates a user interface console of the present invention affixed to a stationary exercise bicycle (one form of exercise device)
Figure 2:
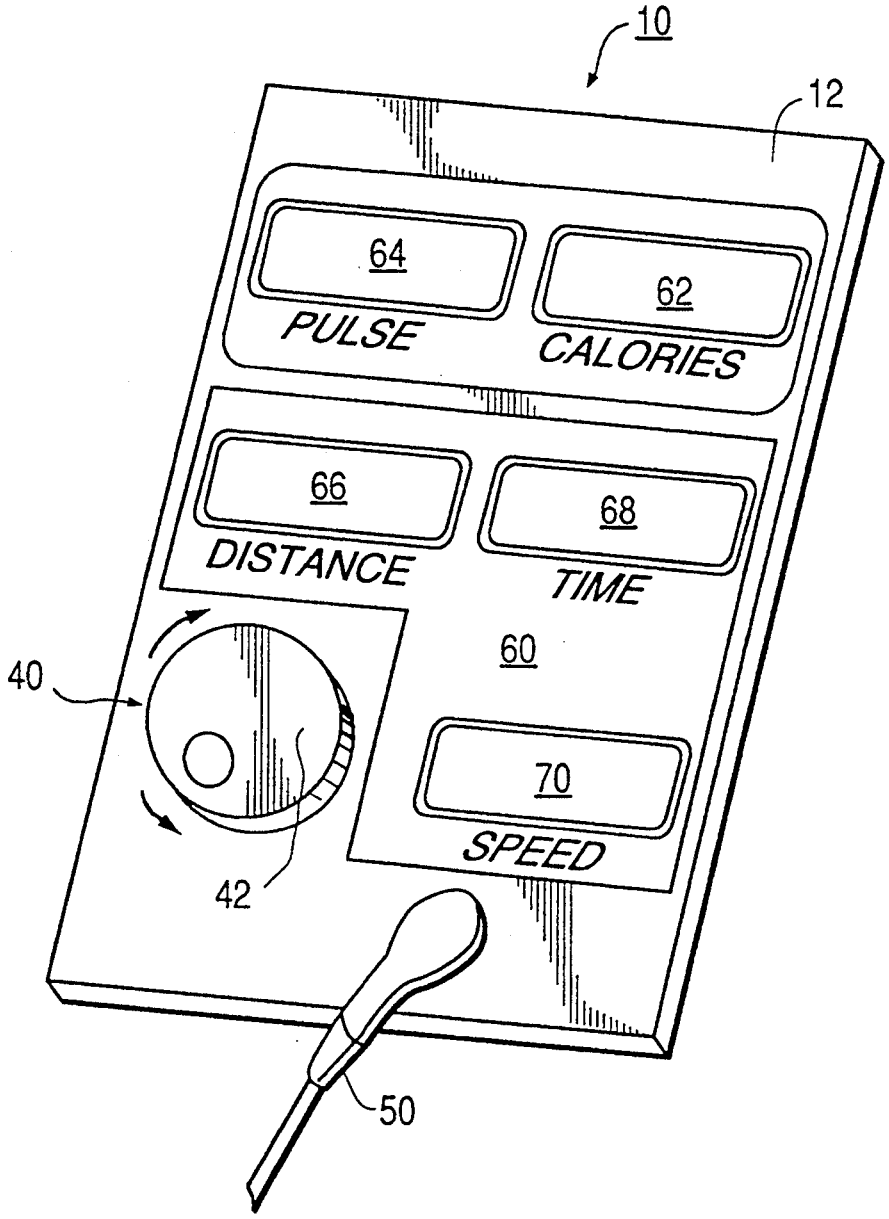
FIG. 2 is a plan view of the user interface console of the present invention.
Figure 4:
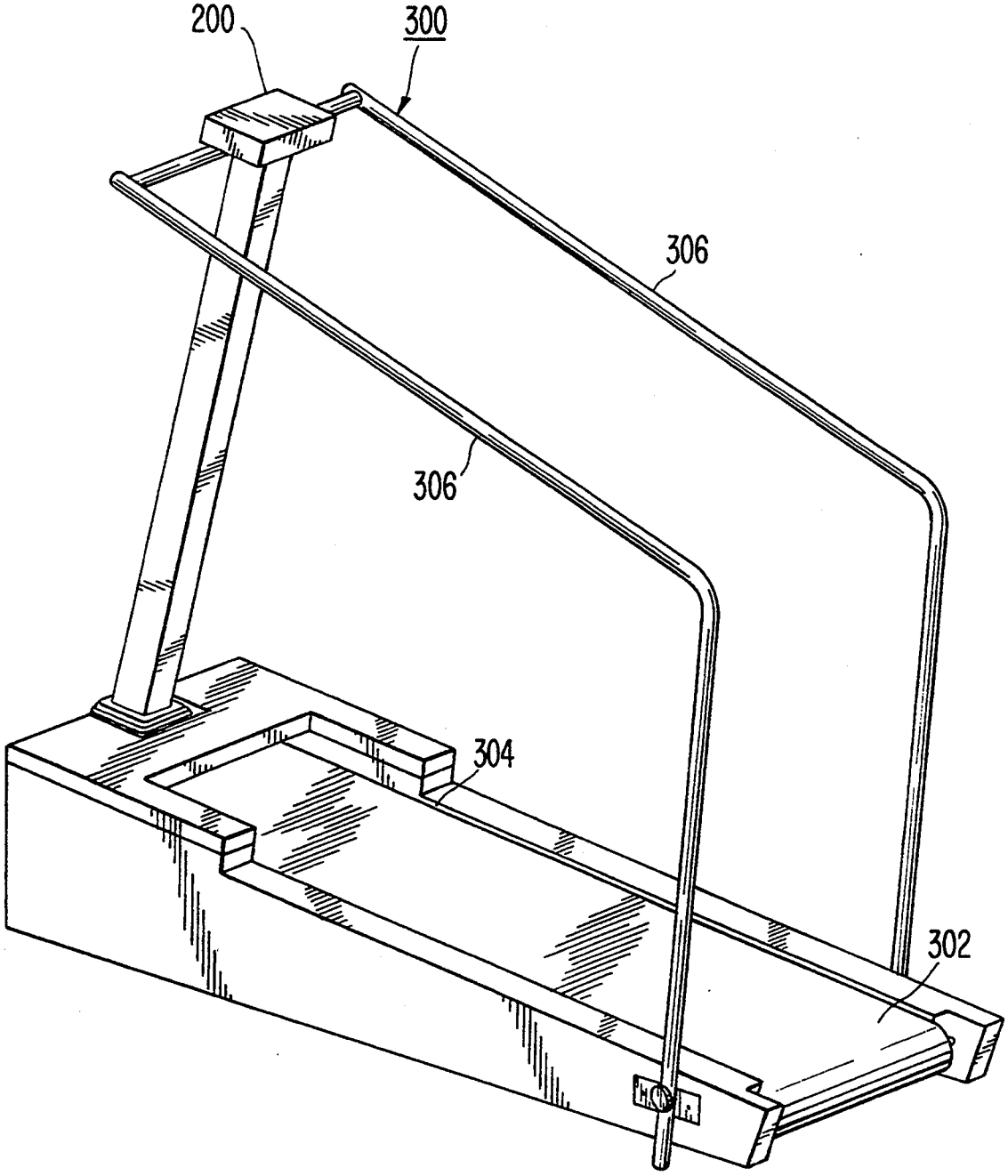
FIG. 4 illustrates an embodiment of the user interface console of the present invention affixed to an exercise treadmill (another form of exercise device)
Figure 5:
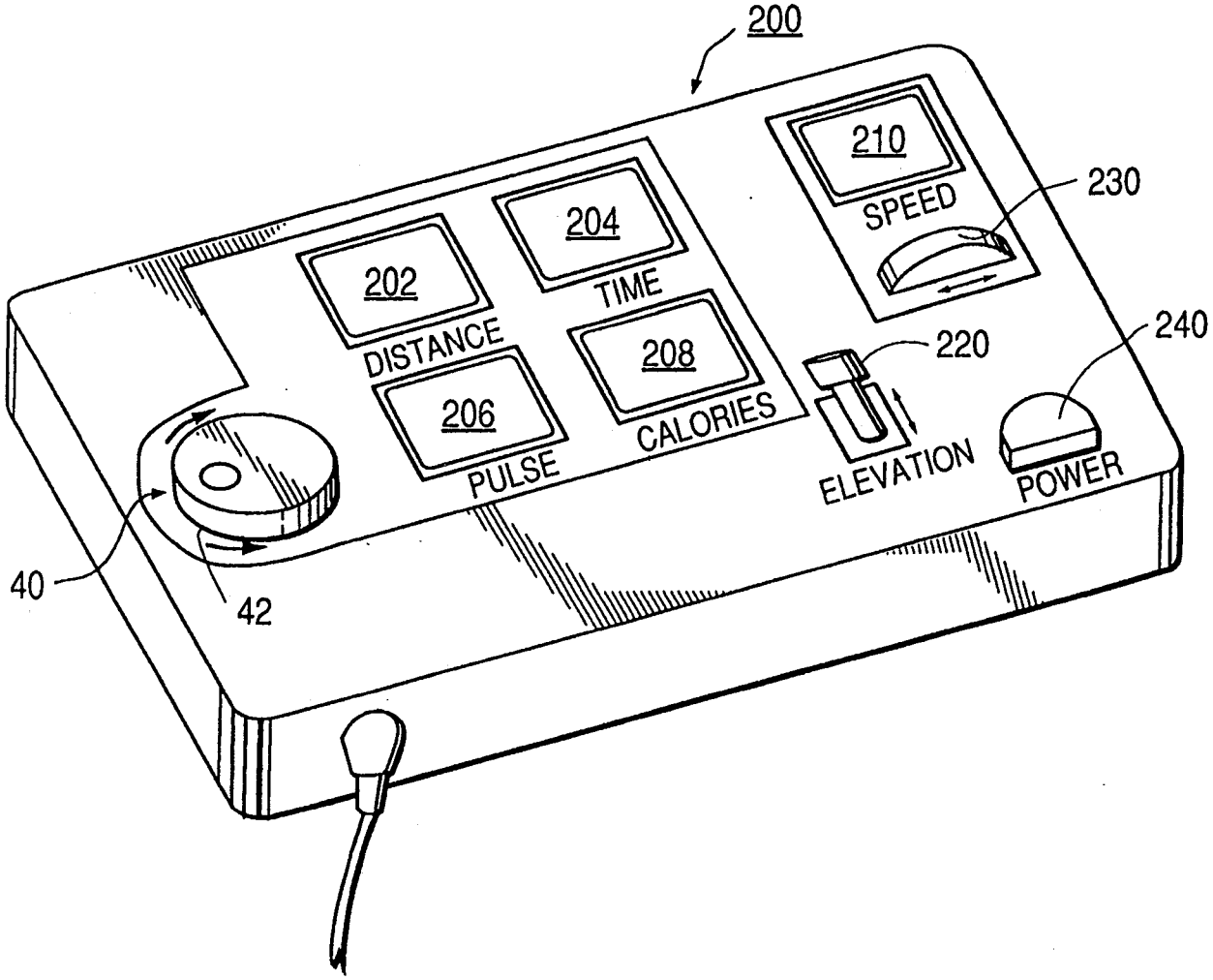
FIG. 5 is a plan view of the user interface console illustrated in FIG. 4.

The user interface console of the present invention may be adapted for use in exercise equipment, for example, an exercise bicycle, a treadmill, a stepper, a rower, a skier, or the like. The user interface console of FIGS. 1 and 2 is described for use with a stationary exercise bicycle. FIGS. 4 and 5 describe an interface console for use with a treadmill. It should be noted, however, that such a user interface console may be implemented or adapted for use with other types of exercise devices, for example, a stepper, a rower, a skier, or the like.

With reference to FIGS. 1 and 2, the exercise system 1 includes a user interface console 10 and an exercise bicycle 20. The console 10 includes a program mode, wherein the user may program exercise parameters of the bicycle 20 as well as the exercise parameters of the user. In the run mode, the console 10 and exercise bicycle 20 execute the exercise regime according to the exercise parameters programmed by the user. In the illustrative embodiment, the exercise parameters relating to the user which may be programmed and monitored include the user's pulse rate and calorie expenditure. The exercise parameters relating to the exercise bicycle 20 which may be programmed and monitored include distance, time and speed.

It should be noted that the stationary exercise bicycle 20 may be any type of bicycle whose exercise parameters, for example speed and distance, may be programmed and monitored.

The user operates the stationary exercise bicycle 20 by manipulating components of user interface console 10. The console 10 monitors the operating or exercise parameters of the bicycle 20 through multi-wire cable 30. The console 10 may also monitor several of the operating or exercise parameters internally, for example the time of and calorie expenditure during the exercise period. The operating or exercise parameter relating to the pulse rate of the user is monitored by an external pulse monitor as indicated below. The pulse rate monitoring technique of the console 10 is also described.

With continued reference to FIGS. 1 and 2, the user interface console 10 is shown affixed to exercise bicycle 20. The user interface console 10 may be affixed to exercise bicycle 20 in any convenient manner.

The console 10 includes housing 12, user interface encoder 40, connector 50, and display panel 60. The housing 11 may be made of any suitable material, such as monolithic injection molded plastic. Further, the console 10 may be powered by a battery and/or an AC power supply.

The display panel 60 may include one or more liquid crystal displays (LCDs) for displaying values of the exercise or operating parameters of the exercise bicycle 20 and the user. In a preferred embodiment, the display panel 60 includes displays 62, 64, 66, 68 and 70 corresponding to the operating or exercise parameters of PULSE, CALORIES, DISTANCE, TIME and SPEED, respectively. The exercise parameters PULSE, CALORIES, DISTANCE, TIME and SPEED are typical exercise parameters. It should be noted, however, that these exercise parameters are illustrative only and others may be included or substituted, if desired.

The user interface encoder 40 is a rotatable encoder and is employed to program the exercise parameters of the exercise bicycle 20 and the exercise parameters of the user. The user interface encoder 40 may be an incremental or relative type encoder which provides electrical signals representative of the relative motion of the encoder shaft. The user interface encoder 40 may also be an absolute type encoder which provides electrical signals representative of the absolute position of the encoder shaft.

In a preferred embodiment, the encoder 40 is a two-bit incremental or relative type encoder manufactured by Bourns having the Model No. ECTOJ. The manufacturer specification sheets for the family of devices having the Model No. ECTOJ are hereby incorporated by reference.

Figure 3:
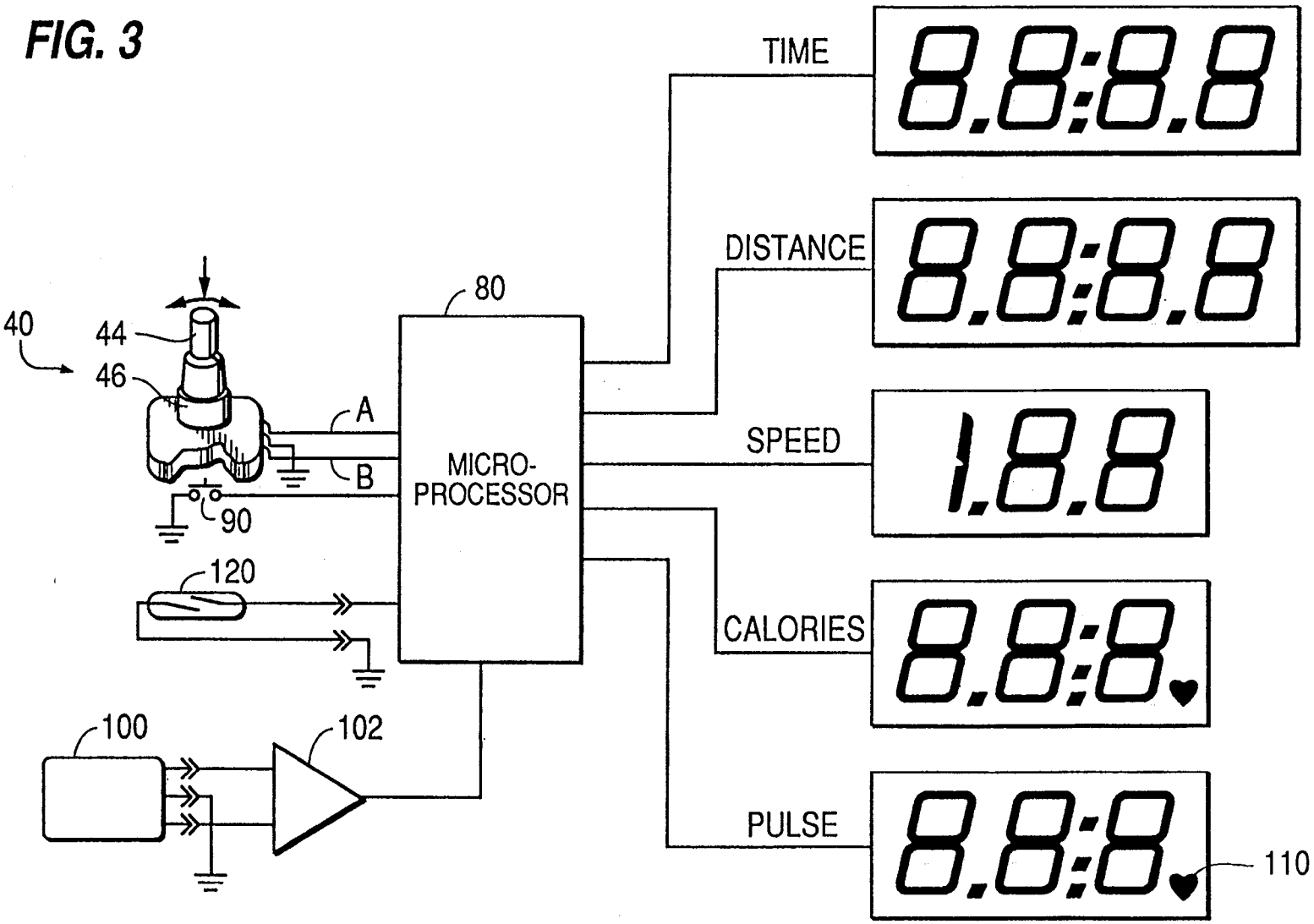
FIG. 3 is a block diagram schematic representation of the user interface console of the present invention.

With reference to FIG. 3, the user interface encoder 40 includes an encoder shaft 44 and a rotational shaft 46. The rotational shaft 46 may be integral with encoder shaft 44. In a preferred embodiment, the interface encoder 40 is a Bourns encoder, Model No. ECTOJ-Z24-SE0015. This particular encoder includes a relative position sensor that encodes the relative position of the encoder shaft 44 as a 2-bit grey code. It also includes an encoder shaft 44 that, along with housing 12, is configured to extend upwardly through the console housing 12 and engage an encoder knob 42 which is mechanically coupled thereto.

In a preferred embodiment, the encoder shaft 44 includes detents thereby defining specific rotational positions for the encoder shaft 44. In a preferred embodiment, there are twenty four (24) detents which translates into twenty four (24) distinct positions for the encoder shaft 44. As a result, in this preferred embodiment, the 2-bit grey code output completes six (6) cycles for each complete revolution of shaft 44.

With continued reference to FIG. 3, as mentioned above, the encoder 40 of a relative or incremental encoder type generates an electrical representation of the relative motion of the shaft 44. The encoder 40 supplies the electrical signals to the microprocessor 80. The microprocessor 80 is appropriately programmed so that it can sense the direction of rotation of the encoder 40. The microprocessor 80 decodes the grey code output of the encoder 40 and responsively adjusts the exercise parameter being programmed. The microprocessor 80 is coupled to the encoder 40 via signal lines channel A and channel B.

In a preferred embodiment, the microprocessor 80 is a four (4) or eight (8) bit microprocessor manufactured by Intel Corporation, for example, Model No. 87C51. The manufacturer specification sheets for the four (4) or eight (8) bit microprocessor manufactured by Intel Corporation are hereby incorporated by reference.

It should be noted that, although obvious from FIG. 2, the housing 12 and the encoder shaft 44 are manufactured and configured so that the encoder shaft 44 extends upwardly toward the console housing 12. The encoder knob 46 is coupled to and engages the encoder shaft 44. As a result, the user engages the encoder knob 43 to thereby rotate the encoder shaft 44. The housing 12, encoder shaft 44 and the encoder knob 46 may be configured in any suitable fashion that allows the user to engage the encoder knob 42 and thereby operate the encoder 40; such configurations are known to those skilled in the art. Further, the encoder knob 43 may be any suitable type knob.

With continued reference to FIG. 3, in a preferred embodiment, the encoder 40 is configured with a push button type switch 90. In this embodiment, the switch 90 is mounted behind the encoder 40 so that it is capable of being engaged and actuated by the encoder shaft 44. The user actuates the switch 90 by depressing the encoder knob 42. When the encoder knob 42 is depressed, the encoder shaft 44 engages the switch 90 to thereby activate the switch 90. In a preferred embodiment, the switch 90 is a the snap-dome type switch.

The switch 90 is employed to initiate the program mode as well as select the exercise parameter or parameters to be programmed. As mentioned above, in the preferred embodiment, the switch 90 is activated by depressing the encoder knob 42. In response to activating the switch 90, the microprocessor 80 initiates the programming mode of user interface console 10 and allows the user to program the exercise parameters of the exercise bicycle 20 and the exercise parameters of the user. The user may select a operating parameter to be programmed by subsequently depressing the switch 90 until the system has "cycled" to the desired operating parameter or parameters, for example, CALORIES.

It should be noted that the switch 90 need not be mechanically coupled to or "integrated" in the encoder 40. Instead, the switch 90 may be a separate "stand-alone" push button switch that is mounted on the console housing 12. Under this circumstance, the user would activate such a switch configuration by depressing the switch, for example, a snap-dome type switch. The operation of this type of switch configuration in the program mode would be identical to the "integrated" encoder-switch configuration.

It should be noted, however, that an advantage of an "integrated" configuration, having the encoder shaft 44 engage and capable of actuating the switch 90, is that the user may access, select, and program all of the operating or exercise parameters through one unitary input device—the encoder 40 with the switch 90 integrated therein.

With reference to FIG. 2 and FIG. 3, the operation of the preferred embodiment of the user interface console 10 is described immediately below. By way of an overview, in operation, the user of the exercise bicycle 20 enters the program mode by activating the encoder 40. The user may select and program any one or all of the programmable operating parameters, e.g., TIME, DISTANCE, CALORIES or PULSE. The user changes the current value of the exercise parameter by rotating the encoder shaft 44, via encoder knob 42. The user rotates the encoder shaft 44 in the appropriate direction (either clockwise or counterclockwise) until the desired value is reached. This procedure is repeated until as many parameters as desired have been programmed.

In particular, in operation to program a particular exercise parameter, the user depresses the encoder knob 42 of the console 10. In response, the user places the console 10 in the program mode and is presented with a first "active" display which corresponds to the "active" exercise parameter or the first exercise parameter that may be programmed. To program the first exercise parameter, the user may rotate the encoder knob 42 until the desired value for the exercise parameter is indicated in the "active" display. A clockwise rotation of the encoder knob 42 increases the values of the exercise parameter. A counterclockwise rotation of the encoder knob decreases the values of the exercise parameter. When the desired value is indicated in the display., the user may stop rotating the encoder knob 42. That exercise parameter is now programmed. The user may depress the switch 90 to proceed to the next exercise parameter or allow the encoder 40 to remain idle whereupon it will "time-out".

In the illustrative embodiment, the first active exercise parameter is TIME. The user may continue to depress the encoder knob 42 until the exercise parameter which the user wishes to modify becomes the "active" parameter. That is, the next exercise parameter may be accessed by depressing the encoder knob 42 again. This now becomes the "active" exercise parameter. Successive depressions of encoder 40 will cause console 10 to "cycle" through the parameters in a repetitive order. For example, in the illustrative embodiment, the exercise parameter order is TIME, DISTANCE, SPEED, CALORIES, PULSE then repeating TIME again and so on (the cycle continues). As a result, if the user wishes to program only the CALORIES exercise parameter, the user must push encoder knob 42 three times or until CALORIES is the "active" display and the "active" exercise parameter.

As mentioned above, the user may program the "active" exercise parameter by rotating encoder knob 42 clockwise to increase the values of the parameter or counterclockwise to decrease the values of the parameter. When the user does not push or rotate the encoder knob 42 for a predetermined period of time, i.e., the console remains idle, the console 10 exits the program mode. In this embodiment, the console 10 is designed to "time-out" and exit the program mode after a predetermined period of time of inactivity of the encoder 40 and switch 90, e.g., four seconds.

It should be noted that while the user is programming an exercise parameter, the display for that parameter continuously displays the value of that parameter. That is, the display reflects the current value of the exercise parameter as the user is programming that parameter. When the user rotates the encoder knob clockwise or counterclockwise, the display will continuously reflect the increasing values or decreasing values, respectively.

In a preferred embodiment, if, during the program mode, the user has programmed the TIME, DISTANCE and/or CALORIES exercise parameters to a value other than zero, then in the run mode of the exercise bicycle 20, the appropriate displays will decrement and count down from the programmed values to zero. When a parameter reaches zero, that parameter's display flashes, indicating a milestone has occurred. At this point, the function may increment from zero and display the incremented value after indicating that a milestone has occurred. Further, if a parameter is unprogrammed or programmed to zero, the parameter will increment indicating elapsed TIME, DISTANCE or CALORIES.

It should be noted that time, distance, and calorie counters are known generally in the art and can be readily interfaced with microprocessor 80 to provide signals for the appropriate displays. For example, the microprocessor 80 may be interfaced with an LCD decoder/driver device such as manufactured by Motorola Inc. Model No. MC14543. This type device may be configured and employed as a counter if desired. The manufacturer specification sheet for the Model No. MC14543 are hereby incorporated by reference.

Programming the PULSE exercise parameter enables the user to monitor the user's pulse rate. The rate of the user may be monitored by a device generally illustrated as a pulse monitor 100. The pulse monitor 100 may be any pulse detector generally known in the art, for example, a conventional ear lobe clip. The detected pulse rate may be amplified by pulse amplifier 102 and provided to microprocessor 80. The microprocessor 80 may then process the pulse rate information as well as provide it to the PULSE display 62.

In one embodiment, the microprocessor 80 may monitor the pulse rate of the user and if the detected pulse rate exceeds a predetermined range an alarm may be sounded or an LED indicator may be activated. In operation, the user programs a target value for the pulse rate in the manner as described above for the other exercise parameters. First, the user accesses the PULSE exercise parameter by depressing the switch 90 until the PULSE is the active exercise parameter. The user may then rotate the encoder knob 42 in the appropriate direction until the desired value of the PULSE TARGET is displayed in the PULSE display 62.

Now, when in the run mode, the microprocessor 80 monitors the pulse rate of the user. The microprocessor 80 compares the actual pulse rate of the user to the chosen target PULSE rate. When the user's pulse rate exceeds a specified range, a warning is activated. For example, if the user programmed the target PULSE rate as 60 beats/minute and the user's pulse is lower than the preset target PULSE rate by, for example 5 beats/minute, then the word "LO" may appear in the PULSE display 62. Conversely, if the user's pulse is higher than the preset target PULSE rate by, for example 5 beats/minute, then word "HI" may appear on the PULSE display. The words "LO" or "HI" may appear intermittently, e.g., they may display for one second of every four seconds if the users pulse is outside the ±5 beat/minute range.

The console 10 may also employ visual and/or audio indicators to represent the user's pulse rate. One example of a visual indicator is the "heart" icon 110. Here the flashing of the heart icon 110 is correlated to the user's detected pulse rate by the pulse detector 100 and supplied to microprocessor 80.

In another embodiment, the heart icon 110 may represent the situation that the pulse rate of the user has exceeded the predetermined range. Under these circumstances, the user may adjust the current exercise routine accordingly, e.g. stop exercising.

Alternately, if the detected pulse rate is greater than or less than the predetermined limit, the appropriate "LO" or "HI" may be flashed along with the current detected pulse until the detected pulse falls within the desired range.

Further, if the user attempts to program the target PULSE rate to a desired value that is not within a range of valid pulse rates, i.e. from 40 to 180 beats per minute, then the PULSE display 62 may indicate the same to the user and accordingly prompt the user to enter a "new" desired pulse rate.

The user interface console 10 of the present invention may be activated by use of a START/STOP type control, for example a push button switch. In one embodiment, however, the console 10 may be provided with an automatic start feature. In this embodiment, the speed of the exercise device may be measured by, for example, reed switch and magnet combination 120. If the detected speed of the exercise device is greater than a predetermined limit, the console assumes the run mode. In this mode the time, distance and calorie counters, and their respective displays, are activated. If the detected speed of the exercise device is less than this predetermined level, the time, distance and calorie counters are inactive. The displays 62–70 may still display the current values, but they do not be incremented/decrement. The pulse display may be active as well.

In an alternative embodiment, the PULSE display 62 may deactivate when the console 10 detects the speed of the exercise bicycle 20 is below a predetermined level. The predetermined level may be determined by the type of exercise equipment on which console 10 is installed. Typical values may be 5.0 MPH for a bicycle, 0.5 MPH for a treadmill and 5 steps/strokes per minute for steppers/skiers. The console 10 may also be provided with an automatic sleep feature where, if microprocessor 80 detects no system activity for a predetermined time, e.g., 1 minute, all of the displays 62–70 will turned off. The microprocessor 80 would then detect a speed detection pulse from switch 120 or for a select key pulse from encoder 40 to trigger a power up from the sleep mode. Once the system 1 is powered up from a sleep mode, the previously programmed values from the preceding session may be automatically implemented into the system 1 until they are subsequently re-programmed by the user.

Referring now to FIGS. 4 and 5, another embodiment of the present invention is shown. This embodiment is adaptable for use with a treadmill. A typically treadmill is illustrated in FIG. 4 in conjunction with the control console 200 of the present invention. The treadmill includes a frame 300, a track or walking treadbelt 302. The frame 300 is part of a walking platform, shown generally at 304 upon which the walking treadbelt 302, which is an endless loop belt, rides. The frame 300 also includes a pair of a side rail 306 that the user can grasp to steady himself while standing or while exercising by walking or running on treadbelt 302.

Console 200 includes displays 202, 204, 206, 208 and 210 corresponding to exercise parameters of DISTANCE, TIME, PULSE, CALORIES and SPEED, respectively. The console 200 operates in much the same way as console 10 from a user programmability perspective. The exercise parameters are programmed in the same manner as described above.

The console 200 also includes an elevation control lever 220, speed control knob 230 and power switch 240. The elevation control may be accomplished using a gas spring strut support beneath the treadmill and activated by the user control lever 220. The speed control may be accomplished by adjusting the position of, or rotating, the speed knob 230. The speed control knob 240 may control a motor by means of a linear taper rotary potentiometer.

Although not illustrated as such, other exercise or operating parameters, including SPEED 230 and elevation 220, may also be programmed by way of encoder 40. It should be noted that the elevation and speed may be controlled in the same manner as the other exercise or operating parameters—by using the encoder 40 as described in connection with the console 10 of FIGS. 1–3. Under this circumstance, the encoder 40 would be employed to program all of the exercise or operating parameters.

Further, it should be noted that the treadmill embodiments may also include an automatic start and/or sleep feature as described above.

It should be understood that the detailed description indicates the preferred embodiments of the present invention, and are given by way of illustration only. Various modifications and changes may be made to the present invention, without departing from the scope or spirit of the invention, as is set forth in the following claims.

What is claimed is:

1. A user interface console for controlling the operating conditions of an exercise device, said user interface having a program mode for programming exercise parameters, said user interface console comprising:

interfacing means for programming said exercise parameters, said interfacing means includes an encoder unit, having a rotatable shaft, for generating digital signals in response to rotation of the shaft, and wherein at least one of said exercise parameters are programmed by rotating said rotatable shaft.

2. The user interface control of claim 1 wherein said select means is integrated in said encoder unit such that said rotatable shaft is capable of responsively engaging and responsively actuating said select means.

3. The user interface control of claim 2 wherein each of said exercise parameters are capable of being programmed by successively actuating said select means.

4. The user-interface control of claim 1 wherein said encoder includes detents for defining a plurality of distinct positions for said rotatable shaft.

5. The user interface control of claim 4 wherein said encoder unit is an incremental type encoder.

6. The user interface console of claim 1 further including microprocessor means coupled to said interfacing means for receiving said digital signals and for responsively adjusting the operating condition of said exercise equipment.

7. The user interface control of claim 6 wherein said encoder unit is an incremental type encoder and wherein said rotatable shaft includes detents for defining distinct positions for said rotatable shaft.

8. The user interface control of claim 7 wherein said interfacing means includes select means for receiving user inputs to select one of the exercise parameters wherein said user selects one of the exercise parameters by actuating said select means.

9. The user interface control of claim 8 wherein said select means is integrated in said encoder unit such that said rotatable shaft is capable of engaging and actuating said select means.

10. The user interface control of claim 6 wherein said encoder is an absolute type encoder and includes detents for defining a plurality of distinct positions for said rotatable shaft.

11. A user interface console for programming exercise parameters relating to the operation of an exercise device, comprising:

displaying means for displaying the value of each of said exercise parameters;

selecting means for selecting one of said exercise parameters to be programmed;

programming means for programming the selected exercise parameter with a desired value, said programming means includes an encoder unit having a rotatable shaft, wherein said user programs the selected exercise parameter by rotating said rotatable shaft and wherein said encoder unit generates digital signals representative of the incremental motion of said rotatable shaft;

microprocessor means, coupled to said programming means and said display means, for receiving said digital signals and for responsively adjusting the displayed value of the selected exercise parameter.

12. The user interface control of claim 11 wherein said select means is a push button switch which is integrated in said encoder unit such that said rotatable shaft is capable of engaging and actuating said switch.

13. The user interface control of claim 11 wherein said encoder includes detents for defining a plurality of distinct positions for said rotatable shaft.

14. The user interface control of claim 13 wherein said encoder unit is an incremental type encoder.

15. A user interface console for controlling the operating conditions of a treadmill exercise device, said user interface console having a program mode for programming exercise parameters comprising:

display means for displaying the value of each of said exercise parameters;

user interfacing means for allowing a user of said treadmill exercise device to program said exercise parameters, said interfacing means includes, an encoder unit having a rotatable shaft for receiving said user inputs and for generating digital signals representative of said user inputs in response to rotation of the shaft, and select means for responsively initiating said program mode and for selecting the exercise parameters to be programmed; and microprocessor means coupled to said interfacing means and said display means for receiving said digital signals and for responsively adjusting the operating condition of said exercise equipment.

16. The user interface control of claim 15 wherein said encoder includes detents for defining a plurality of distinct positions for said rotatable shaft.

17. The user interface control of claim 16 wherein said encoder unit is an incremental type encoder.

18. The user interface control of claim 15 wherein said select means is integrated in said encoder unit such that said rotatable shaft is capable of engaging and actuating said select means.

19. A user interface console for controlling the operating conditions of a stationary bicycle exercise device, said user interface console having a program mode for programming exercise parameters comprising:

display means for displaying the value of each of said exercise parameters;

interfacing means for allowing a user of said bicycle exercise device to program said exercise parameters, said interfacing means includes, an encoder unit having a rotatable shaft for receiving said user inputs and for generating digital signals representative of said user inputs in response to rotation of the shaft, and select means for responsively initiating the program mode of the user interface console and for selecting a selected one of said exercise parameters; and microprocessor means coupled to said interfacing means for receiving said digital signals and for responsively adjusting the operating condition of said bicycle exercise device.

20. The user interface control of claim 19 wherein said encoder includes detents for defining a plurality of distinct positions for said rotatable shaft.

21. The user interface control of claim 20 wherein said encoder unit is an incremental type encoder.

22. The user interface control of claim 19 wherein said select means is integrated in said encoder unit such that said rotatable shaft is capable of engaging and actuating said select means.

* * * * *

UNITED STATES PATENT AND TRADEMARK OFFICE

CERTIFICATE OF CORRECTION

PATENT NO. : 5,383,826

DATED : January 24, 1995

INVENTOR(S) : Michael Farnet

It is certified that error appears in the above-indentified patent and that said Letters Patent is hereby corrected as shown below:

On the title page, under item [19], change "Michael" should be --Farnet --.

Item [75] Inventor: "Farnet Michael" should be --Michael Farnet--.

Signed and Sealed this

Fourth Day of April, 1995

*Attest:*

BRUCE LEHMAN

*Attesting Officer*

*Commissioner of Patents and Trademarks*